United States Patent [19]

Nakase et al.

[11] Patent Number: 4,734,703

[45] Date of Patent: Mar. 29, 1988

[54] THREE-WAVE ANTENNA FOR VEHICLE

[75] Inventors: Kazuhiko Nakase, Tokyo; Yoshima Egashira, Kanagawa, both of Japan

[73] Assignee: Harada Kogyo Kabushiki Kaisha, Tokyo, Japan

[21] Appl. No.: 774,749

[22] Filed: Sep. 11, 1985

[30] Foreign Application Priority Data

Apr. 1, 1985 [JP] Japan ..... 60-68853

[51] Int. Cl.[4] ..... H01Q 5/00; H01Q 21/28

[52] U.S. Cl. ..... 343/790; 343/715; 343/750; 343/853; 343/905

[58] Field of Search ..... 343/712, 711, 790–791, 343/713, 714, 715, 725, 750, 905, 830, 890, 852, 853, 749

[56] References Cited

U.S. PATENT DOCUMENTS 2,002,844 5/1935 Aceves et al. ..... 343/852
2,888,555 5/1959 Stover ..... 343/725 X
4,149,169 4/1979 Weber ..... 343/725 X

*Primary Examiner*—Marvin L. Nussbaum
*Attorney, Agent, or Firm*—Koda and Androlia

[57] ABSTRACT

A three-wave common antenna for AM/FM and ultra high frequency waves combined in a single unit and mounted on vehicles including AM/FM antenna element mounted on a vehicle body at its base, a non-grounded type ultra high frequency antenna element disposed on top of the AM/FM antenna element such that the beam in a vertical plane thereof is close to the horizontal direction, a coaxial feeder cable for ultra high frequency which, along the AM/FM antenna element, is led into a vehicle body with one end thereof connected to the ultra high frequency antenna element, a characteristic compensating circuit connected to the AM/FM antenna element, and a feeder cable for AM/FM waves connected to the characteristic compensating circuit.

1 Claim, 4 Drawing Figures

THREE-WAVE ANTENNA FOR VEHICLE

BACKGROUND OF THE INVENTION

1. Field of the Invention

The present invention relates to a three-wave antenna to be mounted on a vehicle, such as an automobile, and more particularly to an antenna which is a combination of a ultra high frequency antenna and an AM/FM antenna.

2. Prior Art

Recently, it has become popular to install various types of wireless devices such as cellular system radio telephone equipment, personal wireless equipment, MCA equipment in vehicles such as automobiles, etc. to be used as movable radio appliances. Ultra high frequency antennas are necessary for these wireless devices and such ultra high frequency antennas are installed on the roof, etc. of the vehicles.

On the other hand, a receiver for AM/FM broadcasting is commonly provided in automobiles, etc., and almost all cars and other vehicles are equipped with AM/FM antennas.

Accordingly, the foregoing ultra high frequency antennas, for example, an ultra high frequency antenna for a radio telephone and a ultra high frequency antenna for a wireless personal communication equipment, need to be installed at different locations from the foregoing AM/FM antennas.

However, installing the ultra high frequency antenna at a different location from where the AM/FM antenna is installed, for example, on the roof of a vehicle, diminishes the appearances of the vehicle in terms of aesthetic design, because installations in the above mentioned manner result in disorderly mounting of a plural number of antennas on the vehicle. Furthermore, holes must be provided separately at a plural number of locations for the installation on the vehicle body and the work for each antenna installation must be performed separately. Consequently, installation becomes complicated and many work steps are required. Besides, the fact that a plural number of sticklike antennas stick out of the vehicle body and this is further undesirable for safety reasons while driving the vehicle.

SUMMARY OF THE INVENTION

The object of the present invention, therefore, is to provide a three-wave common antenna that is not only capable of receiving AM/FM waves for general broadcasting, but is also capable of receiving and transmitting the preferred ultra high frequency waves according to the required purpose.

A further object of the present invention is to provide a three-wave antenna which does not hurt the appearance of an automobile in its design aesthetics.

Still a further object of the present invention is to provide a three-wave antenna which is desirable also from the viewpoint of safety while the vehicle is being driven.

In keeping with the principles of the present invention, the objects are accomplished by a unique structure for a three-wave common antenna including an AM/FM antenna element, ultra high frequency (UHF) antenna element, a coaxial feeder cable for UHF wave, a characteristic compensation circuit, and a feeder cable for AM/FM waves. The AM/FM antenna is mounted on a vehicle body, and the UHF antenna element is attached on top of the AM/FM antenna such that the beam in a vertical plane of the UHF antenna is approximated to the horizontal direction, and the coaxial feeder cable, connected to one end of the UHF antenna element, is fed into the body of the vehicle along the AM/FM antenna element. The characteristic compensation circuit is connected to the AM/FM antenna element and the feeder cable for the AM/FM waves is connected to the characteristic compensation circuit.

As seen from the above, the AM/FM antenna element is provided on a supporting pole for installing the non-grounded system ultra high frequency antenna element away from the body of the vehicle. In this manner, the body of the vehicle avoids effecting the directivity. Also, the coaxial feeder cable for ultra high frequency is inserted into the body of the vehicle along the AM/FM antenna element (in other words, for example, by passing the cable through the inside of the antenna element). Thus, an antenna that commonly can be used for three types of waves can be constructed as a single antenna. Further, characteristics which lower the grade of the antenna such as insufficient length of the AM/FM antenna element, which mainly stem from restrictions on the total length of the antenna for conveniently putting the vehicle in a garage, etc., can be avoided by the characteristic compensating electric circuit.

DETAILED DESCRIPTION OF THE INVENTION

Figure 1:
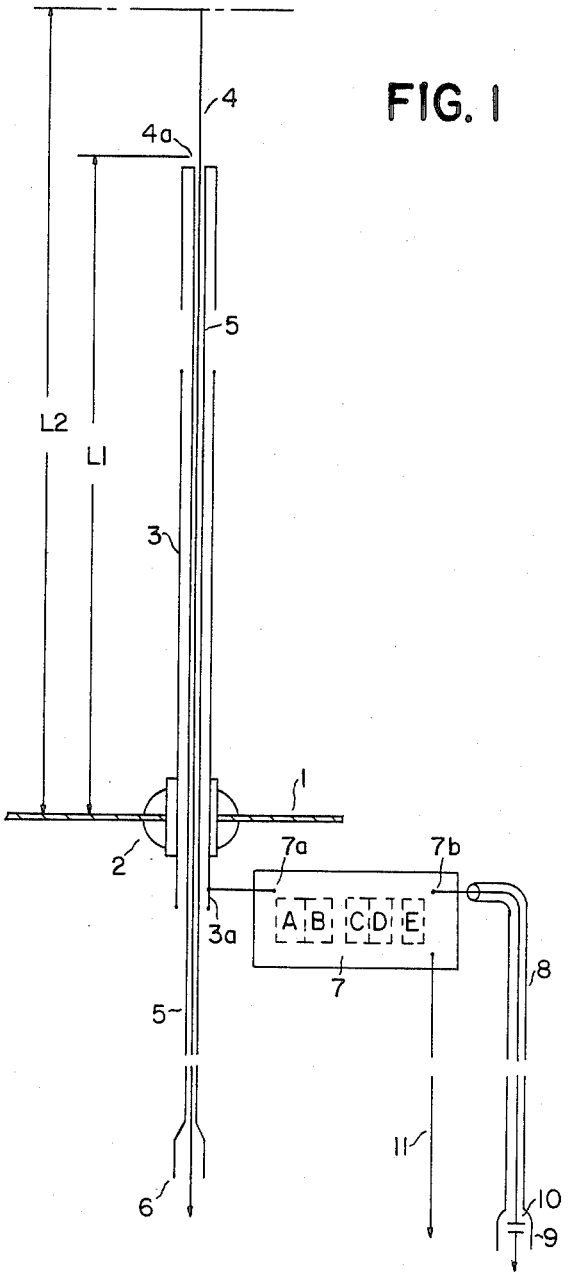
FIG. 1 is a structural sketch showing the principle of a three-wave common antenna according to thepresent invention.

Referring to FIG. 1, it is a structural sketch showing an embodiment wherein the present invention is applied to a three-wave common antenna for automobiles, obtained by combining an AM/FM antenna with a cellular system radio telephone antenna which is claiming increasingly expanding demand for its use at the most important means for communication today and in the future.

In the Figure, numeral 1 denotes a body wall of an automobile. At the antenna fitting location of this body wall 1, the base of an AM/FM wave receiving antenna element 3 is fixed. The foregoing AM/FM antenna element 3 is made of metal pipe, and it serves also as a supporting pole for an ultra high frequency antenna which will be mentioned below. At the head of the above mentioned AM/FM antenna element 3, an ultra high frequency antenna 4, which is used for a cellular system radio telephone, is disposed. This ultra high frequency antenna element 4 is an isolated neutral system dipole antenna element of about 200–300 mm in total length. The feeding portion 4*a* of the foregoing ultra high frequency antenna element 4 is disposed at a position separated from the surface of the body wall 1 by a distance L1 that is longer than one wavelength, in order to reduce the effect of the body wall 1 on the directivity of the antenna. Also, this feeding portion 4*a* is laid out in such a manner that the beam in the vertical plane approaches the horizontal direction.

In this case, it is desirable for the total length L2 of the antenna to be set at about 900 mm or less when parking the car in the garage is considered. Accordingly, the length of the AM/FM antenna element 3 that is disposed below the ultra high frequency antenna element 3 is limited to be about 400–600 mm. This length is considerably shorter than the length of the antenna for λ/4 which is approximately 750–1000 mm in the ordinary FM frequency band, and it becomes a capacitive one. Consequently, for the FM wave, the optimum antenna length cannot be obtained, and impedance mismatching and gain decrease are invited. Also as to the AM wave, the impedance of the antenna is increased by the portion proportional to the shortening of the antenna length, and in relation to the capacity of the feeder line, lowering of sensitivity is caused. Therefore, in order to compensate for such degradation in characteristics, a characteristic compensation electric circuit 7, as will be mentioned later, is provided.

To the aforementioned feeding portion 4*a* of the ultra high frequency antenna element 4, one end of a coaxial feeder cable for ultra high frequency 5 is connected. The other end portion of this coaxial feeder cable 5 is led inside of the body of the vehicle through the inside of the AM/FM antenna element 3. A connector 6 is connected to the other end of the foregoing coaxial feeder cable 5.

An antenna end connection (antenna connecting terminal) 7*a* of the characteristic compensating electric circuit 7 is connected to the feeding portion 3*a* of the AM/FM antenna element 3. This characteristic compensating electric circuit 7 is provided to compensate for the degradation in characteristics, caused by the insufficient length of the AM/FM antenna element 3. This characteristic compensating electric circuit 7 includes an impedance matching transformer A for FM waves and an amplifier B, in order to compensate for the impedance mismatching as well as gain reduction as to the FM waves, which are caused because it is impossible to obtain the optimum length of the antenna. In addition, an impedance transformer for AM waves C and an amplifier D are also included in the characteristic compensating electric circuit 7, in order to compensate for, with respect to the AM waves, increments of antenna impedance and lowered sensitivity in relation to feeder line capacity, which are caused by the shortness (insufficient) of the length of the antenna. With such an arrangement provided, mutual interference between the AM waves and FM waves is checked and thereafter, by way of a circuit E for mixing both types of waves, they are output from the end connection of the feeder cable 7*b*.

The coaxial feeder cable 8 for AM/FM waves (hereafter referred to as feeder cable 8 in order to differentiate it from the coaxial feeder cable 5) is connected at one end to a feeder end cable connection 7*b*. A connector 9 is attached to the other end of the feeder cable 8. This connector 8 is provided with a built-in condenser 10 that serves to set the electrostatic capacity on the antenna side when looked from the plug for the foregoing connector 9 to be 80 PF. Numeral 11 is a power supply line for supplying DC power for operation to the electronic circuit of the characteristic compensating electric circuit 7.

Figure 2:
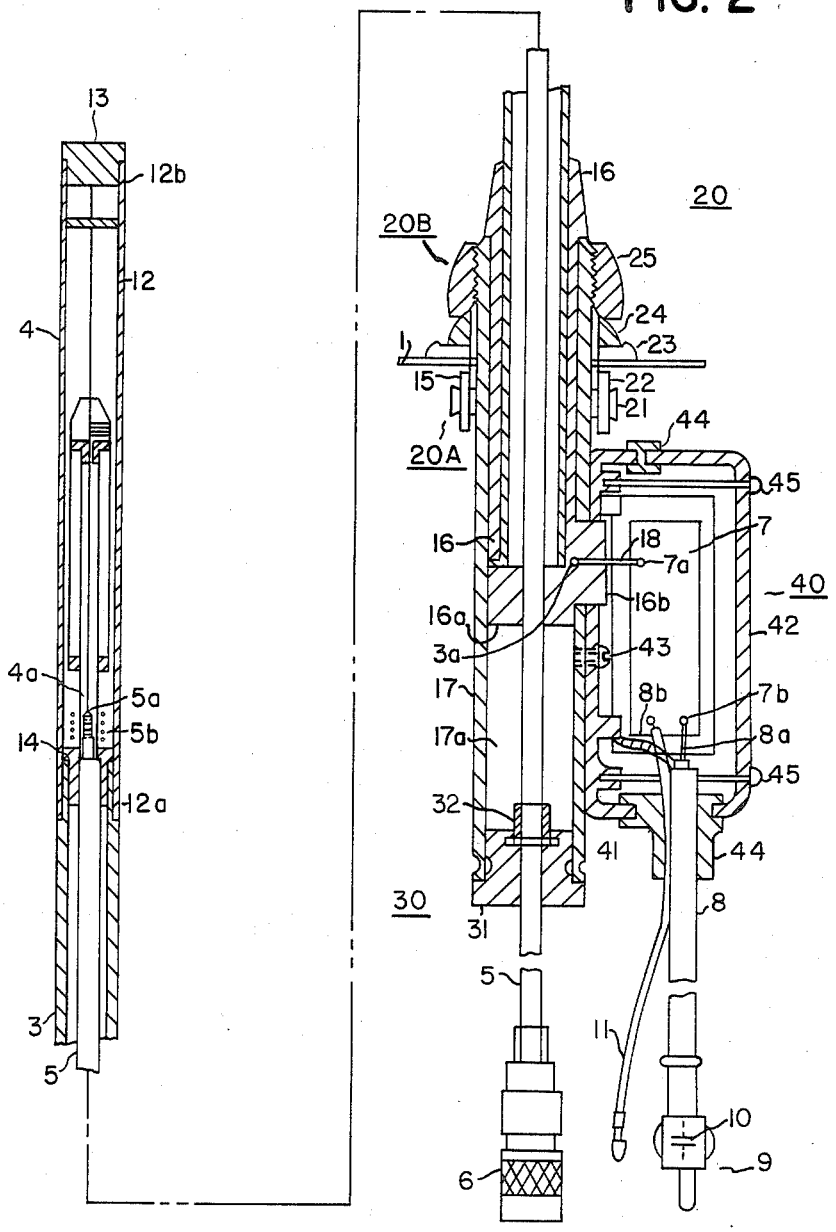
FIG. 2 is a sectional view showing the concrete structure of the antenna of FIG. 1.

FIG. 2 is a sectional view showing the concrete structure of the three-wave common antenna (an antenna commonly used for three types of different waves) in FIG. 1. As shown in FIG. 2, the outer circumferential surface of the ultra high frequency antenna element 4 is covered with a protective pipe 12 made of reinforced glass resin (FRP). The root 12*a* of this protective pipe 12 is connected to the head portion of the AM/FM antenna element 3, by press fitting, adhesion, or other means. At the head 12*b* of the foregoing protective pipe 12, a cap 13 for preventing the intrusion of rainwater, etc. is mounted. The upper end portion of the coaxial feeder cable for ultra high frequency 5 is fixed to the upper end open area of the metal pipe constructing the AM/FM antenna element 3, by being supporting by a supporting member 14. The central conductor 5*a* and the outer conductor 5*b* of the foregoing coaxial ultra high frequency feeder cable 5 are connected to the feeding portion 4*a* of the ultra high frequency antenna element 4.

The AM/FM antenna element 3 and the coaxial feeder cable 5 are led inside the vehicle body through a fitting hole 15 in the body wall 1. Onto the outer circumferential surface of the portion of the body wall through which the antenna element 3 passes the body wall 1, as well as the outer circumferential surface of the portion along which the antenna element 3 is led into the vehicle body, a bottomed, cylindrical form insulating cylinder 16 is fit from below. Furthermore, a cylinder 17 made of metal is fitted onto the outer circumferential surface of the insulating cylinder 16.

The coaxial feeder cable 5 inserted into the antenna element 3 is led downward by passing through the center of the bottom wall 16*a* that closes the lower end of the insulating cylinder 16. At a part of the outer circumferential surface of the bottom wall 16*a*, a protruding portion 16*b* is formed. This protruding portion 16*b* sticks out to the outside of the cylinder 17, through a hole formed at the center portion of the circumferential wall of the cylinder 17. At the center of the protruding portion 16*b* mentioned above, a connecting wire 18 is provided. This wire 18 will make a connection between the feeding portion 3*a* of the antenna element 3 and the antenna end connection 7*a* of the characteristic compensating electric circuit 7.

The outer circumferential wall of the upper end portion of the cylinder 17 is fit and fixed to the body wall 1, by means of a fitting assembly 20 that corresponds to a fitting means 2 shown in FIG. 1. The fitting assembly 20 is formed of a lower fitting element 20A and an upper fitting element 20B. The fitting element 20A also serves as ground fittings.

The lower fitting element 20A includes a conductive ring member 21 and contact members 22. The conductive ring member 21 is fixed into the outer circumferential surface of the cylinder 17. The contact members 22 are conductive, and these conductive contact (pad) members 22 are protrude at a plural number of locations on the foregoing conductive ring member 21, such that they can come into contact with the underside of the body wall 1.

The upper fitting element 20B includes a pad 23, an adjustable fitting seat 24, and a lock nut 25. The pad 23 is made of soft material, such as rubber, and is fit onto the protruding portion of the cylinder 17, that is sticking out to the outside of the body wall, in a form which comes into contact with the surface of the body wall 1. The adjustable fitting seat 24 is made of hard synthetic resin, etc. in a hemispherical shape. The same as the pad 23, this adjustable fitting seat 24 is fit over the protruding portion of the cylinder 17, and is disposed in a form to be mounted on the pad 23. The lock nut 25 is made of hard material, such as metal, and as the pad 23, the seat 24 is fit onto the protruding portion of the cylinder 17, by being screwed to an external thread formed over the outer circumferential surface of the foregoing protruding portion of the cylinder 17. This lock nut 25 is disposed in such a manner that the bottom surface of the lock nut 25 is pushed into contact with the adjustable fitting seat 24.

By means of the foregoing structure, this fitting assembly 20 safely and reliably fit the whole body of the antenna to the body wall 1, through clamping the lock nut 25 while setting the whole body of the antenna vertically by adjusting the adjustable fitting seat 24 according to the inclination of the fitting surface of the body wall 1.

The coaxial feeder cable 5 led downward by passing through the center of the bottom wall 16*a* of the insulating cylinder 16 is further led into the vehicle body through the center area of a cable fixing assembly 30 which is fit to the opening portion of the lower end of the cylinder 17. The cable fixing assembly 30 is formed of a fixing seat 31 and a holding member 32. The fixing seat 31 is made of synthetic resin, etc. in a disc form, and is fixed at the opening area of the lower end of the cylinder 17, by roll caulking or other methods. The holding member 32 is combined with the center portion of the upper end surface of the fixing seat 31 to hold the coaxial cable 5, by tightly pressing it from outside. In this way, the cable fixing assembly 30 fixes the coaxial feeder cable 5 so that it does not easily slide in the longitudinal direction.

To the portion of the outside surface of the cylinder 17 where the protruding portion 16*b* is sticking out, a case 40 that houses the characteristic compensating electric circuit 7 is provided. This case 40 includes a first portion 41 that is disposed on the fitting side and a second portion 42 that is joined to the first portion 41 to form a single unit together with the first portion. The first portion 41 is fixed to the cylinder 17 by means of a plural number of set screws 43. The second portion 42 is joined at its opening area to the opening area of the first portion 41 by means of waterproof packing 44. Furthermore, the second portion 42 is fixed to the first portion 41 by means of a plural number of set screws 45.

The antenna end connection 7*a* of the characteristic compensating electric circuit 7 that is housed in the case 40 is connected to the one end of the previously mentioned connecting conductor 18. On the other hand, the feeder cable end connection 7*b* of the characteristic compensating electric circuit 17 is connected to a cable conductor 8*a* that is the inner conductor of the feeder cable 8 led into the case 40 by passing through the waterproof packing 44. A braided wire 8*b*, that is the other conductor of the feeder cable 8, is connected to the inside bottom portion of the first portion 41 to be grounded. The DC power line 11 of the characteristic compensating electric circuit 7 passes through the waterproof packing 44 together with the feeder cable 8.

In the embodiment constructioned as described above, the AM/FM antenna element 3 is disposed at the location for a supporting pole that is to serve to install the isolated neutral system ultra high frequency antenna element 4 by separating it from the body wall 1 in order to avoid the effect of the body on the directivity. Also, it is designed that the coaxial feeder cable for ultra high frequency is inserted in the vehicle body through the inside of the AM/FM antenna element 3. Therefore, an antenna which can be used for three different types of waves is formed by a single antenna.

Degradation in characteristics due to insufficiency in length of the AM/FM antenna element 3, which is caused by restriction on the total length of the antenna taking into such conditions as parking the vehicle in a garage, can be sufficiently compensated for by the characteristic compensating electric circuit 7.

Figure 3:
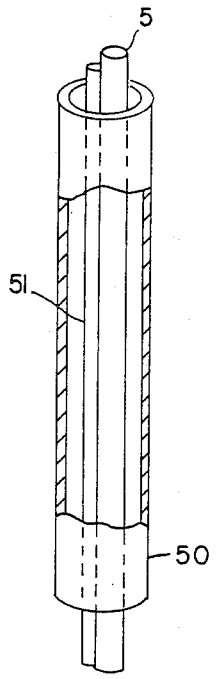
FIGS. 3 and 4 are perspective views showing the main portions of the other embodiments of the present invention, respectively.
Figure 4:
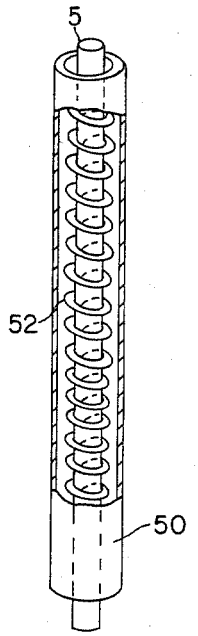

The present invention is not limited to the foregoing embodiment. For example, in the embodiment mentioned above, a metal pipe 3 is used as the AM/FM antenna element 3 and this metal pipe is used as a supporting pole for fitting the non-grounded system ultra high frequency antenna element 4 at a location away from the body wall 1. However, as shown in FIGS. 3 and 4, instead of the metal pipe, reinforced glass resin (FRP fiber reinforced plastics) pipe 50 may be used. At the same time, as shown in FIG. 3, a metal wire 51 may be provided along the inner circumferential surface of the FRP pipe 50 to be used as the AM/FM antenna element. Further, as shown in FIG. 4, a conductor 52 may be coiled into a helical shape around the outer circumferential surface of the coaxial feeder cable 5 to be used as the AM/FM antenna element. In the modified embodiment in FIG. 4, the length of the AM/FM antenna element can be virtually shortened.

The metal wire 51 and the helical conductor 52 shown in FIGS. 3 and 4 are not necessarily disposed inside of the FRP pipe 50. They may be provided along the outer circumferential surface of the FRP pipe 50, depending on necessity. Furthermore, in the foregoing embodiment, as the AM/FM antenna element 3, a single metal pipe is used. However, a plural number of metal pipes with different diameters may be slidably connected to form a multistage system antenna element which may be retracted into the body of the vehicle. In this case however, the coaxial feeder cable 5 must be disposed so that it does not interfer with the sliding movement of the antenna as mentioned above.

In addition, in the above described embodiment, the characteristic compensating electric circuit 7 is housed in the case 40. However, if the electric circuit 7 is small in size it may be stored in the space 17*a* formed below the cylinder 17. Besides, in the above described embodiment, a non-grounded system dipole antenna 4 is used as the ultra high frequency antenna element for cellular system radio telephones. However, the ultra high frequency antenna element is not limited to that use only but can also be used for personal wireless antennas, MCA equipment antennas and may be employed in many other uses. Also, not only a dipole antenna, but also a colinear antenna may be used instead in order to increase gain.

Moreover, it should be obvious that though the present invention is described in terms of three-wave common antennas for automobiles in the above described embodiments, it is also applicable to many different kinds of vehicles in addition to automobiles. It should further be understood that various changes and modifications could be made without departing from the spirit and scope of the present invention.

It should be apparent from the above description that the present invention is advantageous in various ways as summarized below.

The AM/FM antenna element is provided at a location where the isolated neutral system ultra frequency antenna element is separated from the vehicle body in order to eliminate the effect of directivity from the vehicle body. Also, the coaxial feeder cable for ultra high frequency is fed inside of the vehicle body along the AM/FM antenna element (for example, by passing through the inside of the foregoing antenna element). Therefore an antenna which is commonly used for three different types of waves is contained in a single antenna.

Furthermore, degradation in characteristics due to insufficient length of the AM/FM antenna element, that in turn restricts the entire length of the antenna, can be compensated for by the characteristic compensating electric circuit. Therefore, it is much easier to park the vehicle in a garage and/or for the vehicle to enter garages with low overhangs, etc. As a result, the three-wave common antenna is of course capable of receiving AM/FM waves for ordinary broadcasting and is also cable of transmitting and receiving specified ultra high frequency (ultra short wave) according to the required need. In addition, the antenna does not hurt the appearance of the automobile in terms of aesthetic design and is also desirable in terms of safety when the automobile is driven.

What is claimed is:

1. A three-wave common antenna for vehicles comprising:

an elongated tubular AM/FM antenna coupled to and extending outwardly from a vehicle body at a lower end, said AM/FM antenna not being an optimum antenna length;

a non-grounded ultra high frequency antenna coupled to an upper end of said AM/FM antenna, a radiation pattern in a vertical plane of said ultra high frequency antenna being substantially in a horizontal direction;

a coaxial feeder cable for ultra high frequency, one end of said coaxial feeder cable being coupled to an input of said non-grounded ultra high frequency antenna and said coaxial feeder cable being led inside of the vehicle body along said AM/FM antenna;

a characteristic compensating electric circuit coupled to an input of said AM/FM antenna for electrically compensating for said AM/FM antenna not being the optimum antenna length; and a feeder cable for AM/FM waves, one end of said feeder cable being coupled to an output of said characteristic compensating electric circuit.

* * * * *